United States Patent [19]
Wicks

[11] 4,198,095
[45] Apr. 15, 1980

[54] ADJUSTABLE RECLINING CHAIR

[76] Inventor: David J. Wicks, Moat Farm, Earl Stonham, Stowmarket, Suffolk, England

[21] Appl. No.: 874,617

[22] Filed: Feb. 2, 1978

[51] Int. Cl.[2] ..... A47C 1/02
[52] U.S. Cl. ..... 297/320; 297/455
[58] Field of Search ..... 297/281, 282, 320, 322, 297/418, 454–457

[56] References Cited

U.S. PATENT DOCUMENTS

| | | | |
|---|---|---|---|
| 363,503 | 5/1887 | Bell | 297/281 |
| 2,725,096 | 11/1955 | Granby | 297/457 |
| 3,972,559 | 8/1976 | Anacker | 297/457 X |

*Primary Examiner*—James C. Mitchell
*Attorney, Agent, or Firm*—Alexis Barron

[57] ABSTRACT

An adjustable reclining chair comprising a frame and a back-rest and squab hinged together, the back-rest pivotally mounted on the frame. A pair of cord members, one to each side of the squab, are attached at their ends to spaced locations on the frame, the cord members passing around stubs projecting laterally from the squab to suspend the latter from the frame. Friction between the cord members and stubs when a user sits in the chair prevents the chair reclining, but by reducing the weight on the squab, the friction is reduced and the degree of recline can be adjusted as desired.

12 Claims, 3 Drawing Figures

ADJUSTABLE RECLINING CHAIR

BACKGROUND OF THE INVENTION (a) Field of the Invention

This invention relates to chairs, and in particular to chairs which may be adjusted at will to support a user in a chosen attitude. Such chairs are usually known as reclining chairs.

(b) Description of the Prior Art

There have been produced many designs of reclining chairs, in which the angle of the chair back-rest may be adjusted from a relatively upright position to a relatively inclined position. With some designs of such chairs, the squab (i.e. the seat portion) may also be adjusted through a range of angles either separately from the adjustment of the back-rest or in dependence thereon. With many of the known designs, the back-rest and/or squab may be set only at one of a predetermined number of positions, although other designs allow adjustment to be effected to any intermediate positions between the extremes of adjustment. For the latter designs, a manually-operated locking device normally must be provided to lock the adjustment at the desired position—but very often such locking arrangements are inconvenient to use and inaccessible when a user is in the chair. Moreover the operation is often insecure.

OBJECTS OF THE INVENTION

It is a primary object of this invention to provide an adjustable reclining chair in which the back-rest thereof can be adjusted by a user in a simple way to take up any attitude within its possible extremes of adjustment. It is another object of this invention to provide a reclining chair in which the squab (i.e. seat portion) is connected to the back-rest and the position thereof with respect to the frame of the chair depends on the degree of inclination of the back-rest.

Another object of this invention is to provide a chair offering exceptional comfort to the user, who may select whatever angle of recline he choses within the limits of adjustment, and when the chair has been so adjusted, the chair remains set at that adjustment. A further object is to provide a reclining chair which is reliable in operation and yet is aesthetically pleasing and easy to adjust.

SUMMARY OF THE INVENTION

In accordance with these and other objects of this invention, there is provided an adjustable chair comprising a frame, a back-rest and a squab, a hinged connection being provided between the adjacent edges of the back-rest and the squab, and the frame pivotally mounting the back-rest at a location spaced from said hinged connection to the squab, there being two stubs projecting one from each side of the squab respectively and spaced from said hinged connection, and two cord members for supporting the squab, the cords being provided one to each side of the squab and associated with one stub respectively, the ends of each cord member being attached to the frame at locations spaced in the front-to-back direction of the squab, and passing with at least one turn around the associated stub so that the angle of the back-rest and squab relative to the frame may be adjusted by sliding the stubs along the cord members, friction between the stubs and the cord members restraining such sliding movement when the chair is in use.

It will be appreciated that when a chair is in use, the greater part of the weight of a user is carried by the squab, and in the chair of this invention, that weight is transferred to the frame by means of the cord members. A force acting rearwardly on the back-rest above its pivotal mounting to the frame tends to move the squab forwardly, but the friction between the cord members and the stubs of the squab resists movement of the stubs along the cord members, and thus of movement of both the squab and back-rest. If now a user at least partially lifts his weight from the squab, the friction is greatly reduced and the stubs may be slid along the cord members. This has the effect of allowing the squab to move forwardly or rearwardly relative to the frame, and thus of swinging the back-rest about its pivotal mounting to the frame, thereby adjusting the amount of recline of the back-rest.

BRIEF DESCRIPTION OF THE DRAWINGS

In order that the invention may better be understood, it will now be described in greater detail and one specific embodiment of chair arranged in accordance with this invention will be described by way of example only, reference being made to the accompanying drawing, in which.

DESCRIPTION OF THE PREFERRED EMBODIMENTS

Figure 1:
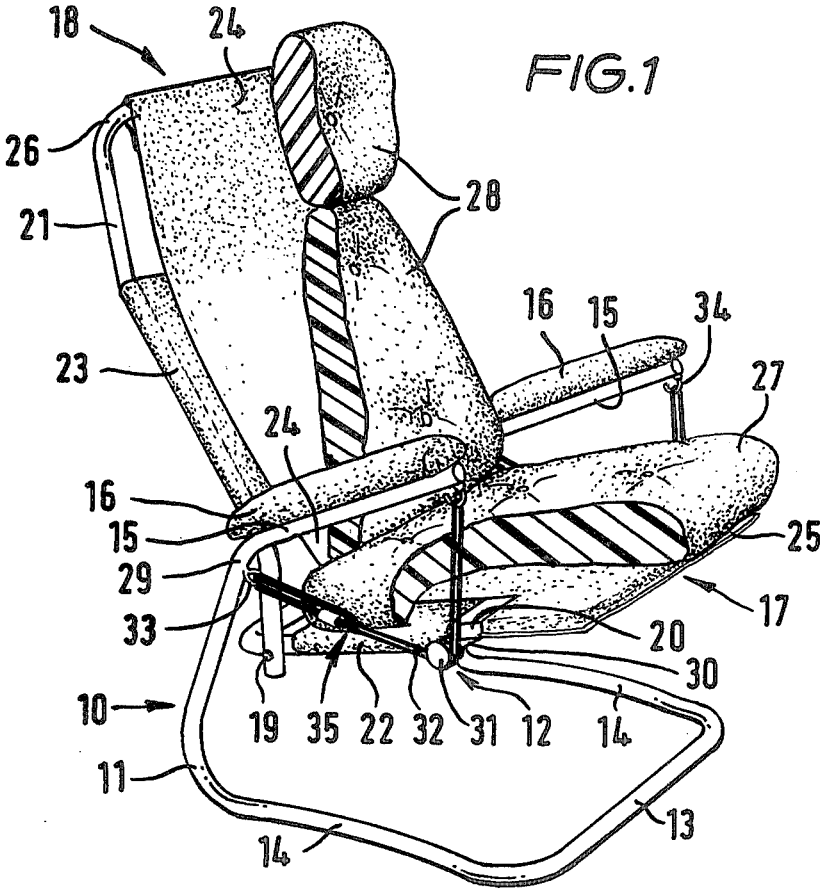
FIG. 1 shows an adjustable reclining chair of this invention.

The frame of the chair may take any appropriate shape for supporting the back-rest and suspending the squab. Preferably, the frame is in the form of two generally U-shaped members which are joined together with their respective opposed limbs parallel and arranged so that when in use at least the lower limbs are generally horizontal to form feet for the chair.

The spacing of the frame members should be such that the squab and back-rest fit therebetween, the back-rest being pivotally mounted to both frame members at or adjacent the mergence of the upper limb and the base portion of the two respective generally U-shape frame members. The rigidity of such a frame may be increased by bracing together the two limbs of each frame member, for instance so that each frame member takes the form of a quadrilateral rather than a U-shape. It is however preferred for each frame member to be made of a material having a degree of resilience and for the design to allow for the frame to "spring" when in use. Advantageously, such a frame is constructed from laminated wood, for this material exhibits high strength and yet may have considerable resilience, or from tubular steel.

With the preferred form of frame, the upper limb of each frame member may serve as an arm-rest for the chair, or may provide a mounting for such an arm-rest.

The back-rest and the squab are preferably separately formed and comprise sub-frames on which the squab and backrest cushions are mounted. Conveniently, the sub-frames are made of tubular metal and a fabric such as canvas may be stretched thereacross to support the cushions. Trials have shown that a particularly comfortable design is achieved if there are provided two fabric supports for the cushions, respectively stretched between the side members of the squab and back-rest sub-frames, and in addition a third fabric support extending between the free ends of the squab and back-rest, and thus bridging the hinged connection between the squab and the back-rest. This third fabric support, provided its length is properly selected, prevents the squab and back-rest cushions wedging into the region of the hinged connection, and thus gives good support to the lowermost portion of the back of a user.

The squab and back-rest may be hinged to each other in any convenient manner which allows a free pivoting movement therebetween. Similarly, the pivotal mounting of the back-rest on the frame may also be effected in any convenient manner, provided that free pivotal movement is allowed between the back-rest and the frame.

The precise points of attachment to the frame of the cord members suspending the squab depend upon both the design of the frame and on the required characteristics of the finished chair. For the preferred form of frame comprising a pair of generally U-shaped members, it is convenient for one end of each cord member to be attached to or adjacent the free end portion of the upper limb of the associated frame member and for the other end to be attached to the frame in the region of the mergence between the said upper limb and the base (i.e. the generally-vertically extending portion) of the associated generally U-shaped frame member. For the latter attachment, it is found that by moving the precise point of attachment up and down said base of the frame member, it is possible to vary the ratio of the total body weight of a user carried by the two portions of each cord member, to each side of the stub on the squab. By moving the attachment point downwardly, a greater tension is applied to the portion of the cord member between the stub and the other attachment, and this in turn gives rise to greater frictional forces of the ends around the stubs.

It is also preferred for each cord member to incorporate means to adjust its length, so that any stretch which may occur in the cord can be taken up and also so that the height of the front edge of the squab, remote from the hinged connection to the back-rest, may be adjusted relative to the ground. Moreover, it is advantageous for one end of each cord member to be attached to the associated frame member in a manner which readily may be disconnected, whereby the number of turns of the cord members around the stubs may quickly and easily be adjusted.

The characteristics of the operation of the chair adjustment will depend inter alia upon the coefficient of friction between the cord and its associated stub as well as the number of turns each cord makes around the associated stub. It has been found that using a synthetic cord, such as of Terylene and a smooth metallic stub of about 1" diameter, a single turn around the stub may be sufficient, but the performance can be improved by using twin cords or strands in parallel and thus extending the angular contact between the cord member and stub. Practical trials have shown that satisfactory operation with a wide range of user's weights may be obtained with angular contact between the cord members and stubs lying in the range from about 540° to 1260°.

To prevent the cord members accidentally jumping off the stubs should the back-rest for example be moved suddenly when the chair is unoccupied, it is preferred for a retainer to be provided to hold the cord member on the stubs. Such a retainer may comprise a spring clip fitted to the stubs and embracing the cord members.

A particularly preferred design of chair incorporating the above features will now be described in detail, referring to the drawings. The chair comprises a frame 10, made from two generally U-shaped frame members 11 and 12 and an inter-connecting part 13 holding the frame members 11 and 12 together at the required spacing and with their limbs 14 and 15 parallel. The frame is made of chrome-plated tubular steel, the frame members 11 and 12 being formed to have the shape shown in the drawings. The lower limbs 14 of the frame members 11 and 12 provide feet for the chair, and are curved slightly along their length so that the mid-portion of each limb is clear of the ground when the chair is standing on the lower limbs 14. The upper limbs 15 of the frame members 11 and 12 lie at an angle to the horizontal and are of a shorter length than the lower limbs 14; these upper limbs 15 serve to support arm-rest cushions 16.

The chair includes a squab 17 (or seat portion) and a back-rest 18, freely hinged together at 19 and disposed between the frame members 11 and 12. Both the squab and the back-rest are constructed from tubular metal sub-frames 20 and 21, the side elements of the back-rest sub-frame being bent as shown in FIG. 1. Both sub-frames 20 and 21 carry canvas sleeves 22 and 23 which are stretched between the side element of the sub-frames. A third canvas support 24 extends between the free ends 25 and 26 of the squab and back-rest sub-frames respectively, the third canvas support 24 lying over the sleeves 22 and 23 and being slightly shorter than the combined linear length of the squab and back-rest. Cushions 27 and 28 rest on the canvas support 24 and are restrained against sliding movement by appropriate fasteners.

Figure 3:
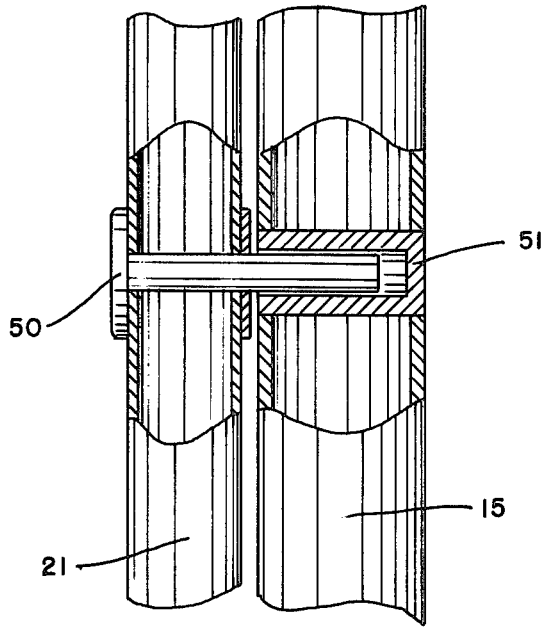
FIG. 3 shows an arrangement for pivotally mounting the back rest to the frame.

Referring to FIGS. 1 and 3, pins 50 are provided on the sub-frame 21 of the back-rest and are received in sockets 51 let into the frame members 11 and 12 in the region 29 of the mergence between the upper limbs 15 and the base portions 14. In this way, the backrest may pivot freely between the two frame members.

The sub-frame 20 of the squab is provided with a pair of laterally extending stubs 30 (only one of which is visible in the drawing) and mounted on the sub-frame 20 part-way between the free end thereof and the pivotal connection to the back-rest sub-frame 21. Each stub has an enlarged head 31 at its free end and is made from chrome-plated steel. The squab sub-frame is suspended from the two frame members 11 and 12 by a pair of cord members 32, each being attached to the associated frame member at two spaced points, and passing around the adjacent stub 30. The rearward attachment 33 is constituted by an eye affixed to the frame cord member in the region 29 adjacent the mergence between the upper limb 15 and the base portion 14, the cord passing through the eye. The forward attachment 34 is constituted by a hook affixed to the free end of the upper limb 15 of the frame member, so that the cord member may easily be hooked on or removed from that attachment. Preferably each cord member 32 is arranged to have two cords or two strands **32*a*, 32*b* extending between the two attachments 33 and 34**, and selectively the cord members may be wound around the associated stubs to suspend the squab and obtain the required characteristics. For example, both strands can be wound either once or twice around the associated stub, or one strand can be wound once and the other either wound twice, or not wound at all. These arrangements give angular contacts between the stubs and cords ranging from approximately 540° to 1620°, though the highest figure is not preferred, and it is found that the greatest contact normally need be no higher than 1260°. These figures assume that the angle between the two major parts of the cords is approximately 90°, the precise angle depends on the length of each cord and the angle to which the chair has been reclined.

Each cord member can be adjusted for length by means of a buckle arrangement 35. Such adjustment may be effected either to take up stretch, or to accommodate an alteration in the number of turns around the stub. An adjustment may also be made to alter the angle of the squab, and in particular the height of the front thereof, to suit a particular user.

Figure 2:
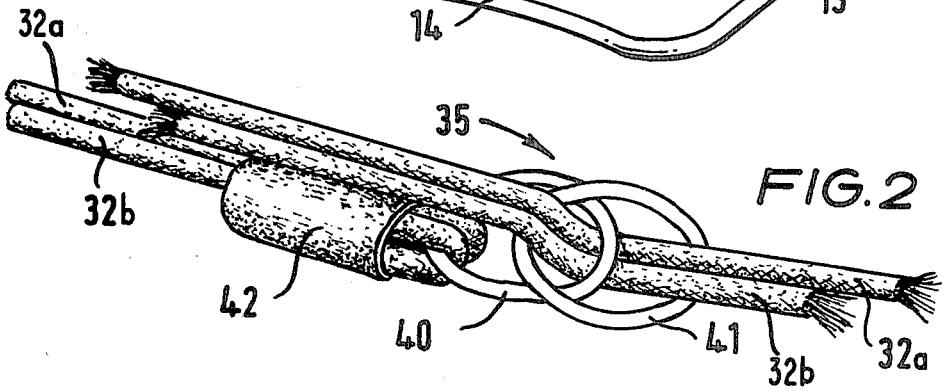
FIG. 2 shows a particular embodiment of buckle arrangement for use in the chair in FIG. 1.

Referring now to FIG. 2, the buckle arrangement 35 is shown in greater detail. The buckle arrangement comprises a first ring 40 passing through loops formed at the free ends of the cords 32*a*, 32*b* by means of a sleeve 42 crimped over the free ends and the main part of the cords, and a second ring 41 overlapping ring 40 to define a kinked path for the cords.

When the cords are not in tension, the rings 40 and 41 may be slidably moved along the cords 32*a*, 32*b* with comparative ease, but when tension is applied, the rings lock on to the cords 32*a*, 32*b*, thereby preventing any relative movement.

In use, when a person sits in the chair, the greater part of that person's weight is carried by the squab 17 and is transferred by the cord members 32 to the frame. Owing to the tension in the cord members, there is considerable friction between the cord members 32 and the stubs 30, and this restrains sliding movement of the stubs along the cord members. In turn, this restrains pivoting movement of the back-rest about its connection to the frame. If however, a person lifts at least some of his weight off the squab, for instance by pressing his arms on the arm rest cushions 16 and by pressing his feet on the ground, the friction is greatly reduced and the stubs may be slid along the cord members. Movement of the squab forwardly or rearwardly hinges the back-rest about its pivotal mounting to the frame, thereby adjusting the amount of recline. When the back-rest is at the desired angle; and the person relaxes once more, the weight being transferred to the frame by the cord members increases the friction with the stubs and restrains movement once more of the stubs along the cord members. In this way, the chair may be adjusted to give more or less recline simply by the user lifting weight from the squab taking up the attitude in which he wishes to sit; and the squab moves forwardly or rearwardly, in response to the user's shift in his position.

By adjusting the effective length of each cord member by means of the buckle arrangement the angle between the two portions of each cord member extending away from the stub may be altered and thus the frictional engagement between each cord member and the stub will be changed. This in turn can affect the amount of friction generated between the stub and the cord members when the chair is in use. Furthermore, adjustment of the cord members will alter the height of the front edge of the squab from the ground, and adjustment may be effected to take up any stretch which may occur in the cord members. The precise action of the chair may also be influenced by lubricating the cords where they pass over the stubs; with chrome-plated stubs and Terylene cords, soap can reduce the stiction effect and allow easy adjustment though secure locking still occurs when relaxing in the chair.

The length of the third canvas support 24 should appropriately be selected so as to be slightly shorter than the combined linear length of the back-rest and squab sub-frames when the chair is in a relatively upright position. If the chair is then reclined, the third canvas support becomes shorter compared to said combined linear length and tends to lift the two squab and back-rest cushions from the sleeves 22 and 23 respectively. The third canvas support thus behaves in the manner of a hammock when the chair is relatively reclined.

I claim:

1. An adjustable chair comprising a frame, a back-rest and a squab, a hinged connection being arranged between the adjacent edges of the back-rest and squab and the frame pivotally mounting the back-rest at a location spaced from said hinged connection to the squab, there being two stubs projecting one from each side of the squab respectively and spaced from said hinged connection, and two cord members for supporting the squab, the cord members being provided one to each side of the squab and associated with one stub respectively, the ends of each cord member being attached to the frame at locations spaced in the front-to-back direction of the squab and passing with at least one turn around the associated stub, so that the angle of the back-rest and squab relative to the frame may be adjusted by sliding the stubs along the cord members, friction between the stubs and the cords restraining such sliding movement when the chair is in use.

2. An adjustable chair as claimed in claim 1, in which the frame is in the form of two spaced generally U-shaped members which are joined together, each U-shaped member having an upper limb disposed above a lower limb and arranged so that when in use at least the lower limbs are generally horizontal.

3. An adjustable chair as claimed in claim 2, in which the spacin of the frame members is such that the squab and backrest fit therebetween, the back-rest being pivotally mounted to both frame members adjacent the mergence of the upper limbs thereof and the respective base portions thereof.

4. An adjustable chair as claimed in claim 3, in which the frame is made from tubular steel.

5. An adjustable chair as claimed in claim 4, in which the upper limb of each frame member serves as a mounting for an arm-rest for the chair.

6. An adjustable chair as claimed in claim 1, in which the back-rest and the squab are separately formed and comprise sub-frames on which squab and back-rest cushions are mounted, there being two fabric supports for the cushions, respectively stretched between the side members of the squab and back-rest sub-frames, and a third fabric support extending between the free ends of the squab and back-rest, bridging the hinged connection between the squab and the back-rest.

7. An adjustable chair as claimed in claim 2, in which one end of each cord member is connected to the upper limb of the associated frame member adjacent the free end thereof, and the other end of each cord member is connected to the frame member in the region of the mergence between the said upper limb and the remainder of the U-shaped frame member.

8. An adjustable chair as claimed in claim 1, in which each cord member incorporates means to adjust the length thereof.

9. An adjustable chair as claimed in claim 1, in which each cord member comprises a pair of cords arranged in parallel to extend the effective angular contact between the cord and associated stub.

10. An adjustable chair as claimed in claim 1, in which the angular contact between the cords and stubs lies within the range from about 540° to about 1260°.

11. An adjustable chair comprising two generally U-shaped frame members joined together to define a frame, each frame member having an upper limb disposed above a lower limb, the respective opposed limbs of the frame members parallel and disposed with the lower pair of limbs generally horizontal, a back-rest comprising a sub-frame pivotally mounted between said frame members, a squab comprising a sub-frame hinged by one edge to the lower edge of said back-rest, two stubs projecting one from each side of said squab sub-frame remote from said hinged connection to said back-rest, two fabric supports respectively stretched over said back-rest sub-frame and said squab sub-frame, a third fabric support extending between the upper edge of said back-rest and the front edge of the squab and overlying said two fabric supports, back-rest and squab cushions carried on said third fabric support, and two cord members, one associated with each stub respectively and passing around the associated stub with an angular contact therewith of from about 540° to 1260°, the two ends of each cord member being attached to the frame at two spaced locations, one said location being adjacent the free end of the upper limb of the associated frame member and the other said location being adjacent the region of the mergence between the upper limb of the associated frame member and the remainder of said frame member.

12. An adjustable chair as in claim 2 in which the opposed upper limbs of each U-shaped member are parallel and the opposed lower limbs of each U-shaped member are parallel.

* * * * *

UNITED STATES PATENT AND TRADEMARK OFFICE

CERTIFICATE OF CORRECTION

PATENT NO. : 4,198,095

DATED : April 15, 1980

INVENTOR(S) : David J. Wicks

It is certified that error appears in the above–identified patent and that said Letters Patent are hereby corrected as shown below:

Column 1, line 22, "positions" should read --position--.

Column 1, line 60, "cords" should read --cord members--.

Column 4, line 54, delete "cord".

Column 4, line 56, after "cord" read --member--.

Column 4, line 62, delete "two" (second occurrence).

Column 6, line 40, Claim 3, second line, "spacin" should read --spacing--.

Signed and Sealed this

*Twenty-second* Day of *July 1980*

[SEAL]

*Attest:*

SIDNEY A. DIAMOND

*Attesting Officer*

*Commissioner of Patents and Trademarks*